US005218855A

United States Patent [19]

Werner et al.

[11] Patent Number: 5,218,855

[45] Date of Patent: Jun. 15, 1993

[54] MANIPULATOR FOR FORGING MACHINES, FOR EXAMPLE MULTIPLE-RAM FORGING MACHINES

[76] Inventors: Eberhard Werner, Regensburger Str. 2, D-5090 Leverkusen 1; Wilhelm Krieger, Gartenstrasse 35, D-5068 Odenthal-Blecher, both of Fed. Rep. of Germany

[21] Appl. No.: 703,942

[22] Filed: May 22, 1991

[30] Foreign Application Priority Data

May 23, 1990 [DE] Fed. Rep. of Germany ..... 4016534

[51] Int. Cl.[5] ..... B21D 43/00; B21J 13/10

[52] U.S. Cl. ..... 72/420; 72/421

[58] Field of Search ..... 72/420, 421, 422

[56] References Cited

U.S. PATENT DOCUMENTS

| | | | |
|---|---|---|---|
| 3,447,349 | 6/1969 | Lippke | 72/421 |
| 3,504,512 | 4/1970 | Knowles | 72/421 |
| 3,557,601 | 1/1971 | Schussler | 72/420 |
| 3,590,616 | 7/1971 | Schussler | 72/421 |
| 3,750,436 | 8/1973 | Harrison et al. | 72/421 |
| 5,000,028 | 3/1991 | Krieger | 72/421 |

FOREIGN PATENT DOCUMENTS

| | | | |
|---|---|---|---|
| 1527354 | 5/1969 | Fed. Rep. of Germany . | |
| 682317 | 8/1979 | U.S.S.R. | 72/420 |
| 997945 | 2/1983 | U.S.S.R. | 72/422 |
| 1317301 | 5/1973 | United Kingdom | 72/422 |

*Primary Examiner*—Lowell A. Larson
*Assistant Examiner*—Donald M. Gurley
*Attorney, Agent, or Firm*—Diller, Ramik & Wight

[57] ABSTRACT

In a manipulator (1) for forging machines, for example multiple-ram forging machines with a plurality of rams acting radially on the forging (2), the workpiece (2) is moved axially according to the forging sequence and the feed drive of the manipulator (1) takes place at a constant speed, an actively controllable, axially effective superposed drive acting intermittently on the gripper axle (5) of the manipulator (1) and at least one hydraulically working piston/cylinder unit (12) being provided for supporting the axially displaceable gripper axle (5) in relation to the manipulator housing (4). To design the control of the manipulator (1) in a mechanically constructive way so that it functions simply and reliably, the front and rear stroke spaces (18, 19) of the piston/cylinder unit (12) are connectable by a line (28) by means of a valve (26), and the piston/cylinder unit (12) is designed as a servo-control device (17), by means of which the piston/cylinder unit (12) can be controlled.

4 Claims, 3 Drawing Sheets

MANIPULATOR FOR FORGING MACHINES, FOR EXAMPLE MULTIPLE-RAM FORGING MACHINES

BACKGROUND OF THE INVENTION

The invention relates to a manipulator for forging machines, for example multiple-ram forging machines with a plurality of rams acting radially on the forging, in which the workpiece is moved axially according to the forging sequence and the feed drive of the manipulator takes place at a constant speed. An actively controllable, axially effective superposed drive acts intermittently on the gripper axle of the manipulator, at least one hydraulically working piston/cylinder unit being provided for supporting the axially displaceable gripper axle in relation to the manipulator housing.

In a known version, the gripper axle is mounted axially displaceably in the manipulator housing and is supported axially via spring elements, so that the gripper axle can move in both directions. During the pressure-contact phase, the workpiece is kept stationary by the forging tools. Because the drive continues to run at constant speed, the gripper axle shifts counter to the spring tension. After the pressure-contact phase has ended, the axle is returned again via the tensioned spring. In the course of the return movement and in interaction with the accelerated masses, not only is the middle position reached by the return, but also the system oscillates into the opposite spring element and even partially back again, the relative speed of the gripper axle and workpiece in relation to the forging machine diminishing to zero or approximately zero before the new pressure-contact phase of the next work cycle begins.

In the oscillating system, the spring tension, the mass forces and the speeds are in direct physical relationship. This system can ensure a proper functioning only when the constructively determined parameters are maintained. Even in the different types of machining (roughing, precision machining), the ratio of the contact time and idle time constitutes a variable and therefore different parameters are obtained for the oscillating system..

The oscillating system has to be tied to a fixed stroke frequency of the forging machine. Since the mass varies as a function of the workpiece size, an adverse effect on the oscillating system as a result of a change of mass arises.

It is known, furthermore, to provide a manipulator control forging machines, in which the forging press and forging manipulator can be controlled in synchronism. The manipulator is moved continuously at a mean speed regulated to the stroke time and to the feed desired for the forging work, whilst the gripper of the manipulator executes together with the forging a movement intermittent in relation to the carriage and the position necessary for the next press stroke is therefore reached in a shorter time than the manipulator as a whole. A controllable axial superposed drive acts for a predetermined time on the axially displaceable gripper axle of the manipulator. At least one hydraulically working piston/cylinder unit is provided for supporting the axially displaceable gripper axle relative to the housing.

SUMMARY OF THE INVENTION

The object of the invention is, in a manipulator for forging machines of the abovementioned type, to design the entire device for controlling the manipulator in a mechanically constructive way so that it functions simply and reliably. The invention is defined in that the front and rear stroke spaces of the piston/cylinder unit are connectable by a line by means of a valve, and in that the piston/cylinder unit is designed as a servo-control device, by means of which the piston/cylinder unit can be controlled.

The arrangement according to the invention ensures that, before the pressure-contact phase is reached, the speed of the gripper axle and consequently of this workpiece in relation to the forging machine reliably becomes zero. This is obtained by means of a direct connection of the stroke space of the piston/cylinder unit, with the result that the active control of the latter is put out of action, and in that the non-predeterminable workpiece elongation resulting from the forging process and therefore the axial shift of the gripper axle relative to the manipulator can occur freely and without constraint. By means of the servo-control, a predeterminable movement characteristic for the axial movement of the gripper axle can be generated. It is then possible for the gripper axle to be capable of executing harmonic movements in a predetermined way, especially to be accelerated and decelerated harmonically. The gripper axle with workpiece can be brought to a standstill even before the start of a forging pass, so that this does not have to be subjected to force by the forging jaws. As a result of the predeterminable direction of the gripper axle, the necessary displacement distance of the axle is appreciably reduced and the mechanical outlay in terms of construction decreased in relation to the conventional design.

The servo-control device is appropriately designed so that a valve is connected hydraulically to the valve on the one hand and to a spindle/nut system on the other hand. By means of the servo-control, a predeterminable movement characteristic can easily be generated for the axial movement of the gripper axle.

According to a further feature of the invention, the servo-control device has a threaded spindle which is connected fixedly in terms of rotation to the piston of the piston/cylinder unit, thereby achieving a linearly direct connection of the valve to the piston.

The invention is explained below by means of an exemplary embodiment illustrated in the drawing.

DESCRIPTION OF THE PREFERRED EMBODIMENTS

Figure 1:
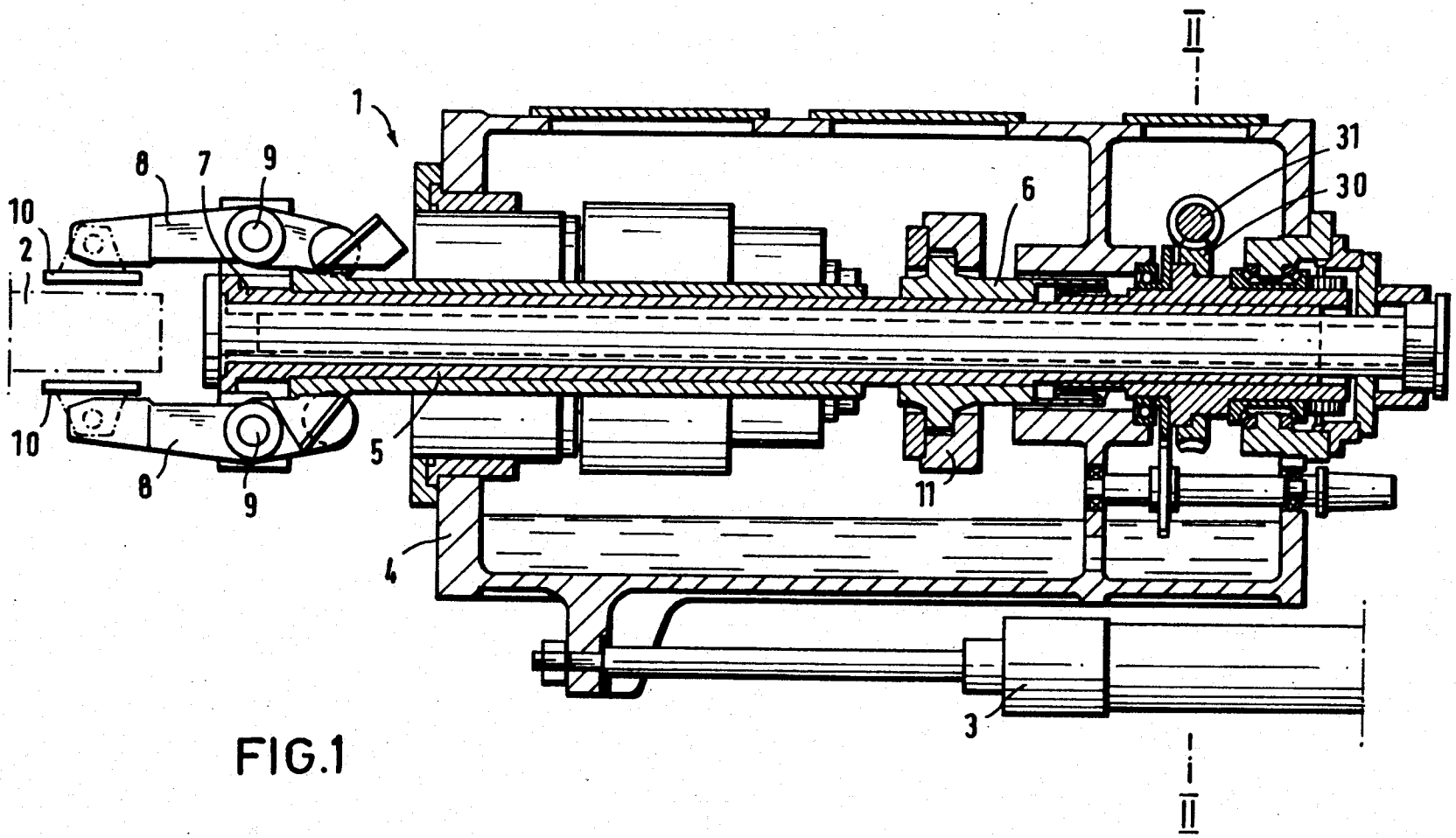
FIG. 1 shows a diagrammatic axial longitudinal section of an embodiment of a manipulator for moving the workpiece.

The manipulator 1 of FIG. 1 moves the workpiece 2 in the axial direction according to the forging sequence. The feed takes place via a drive, for example a hydraulic cylinder 3, which is connected to the manipulator housing 4. The gripper axle 5 is mounted axially displaceably in the manipulator housing 4; the axial mounting is obtained via the hub 6 connected fixedly to the gripper axle 5. Arranged at the front free end of the gripper axle 5 on a projecting collar 7 is a predetermined number of gripper levers 8 which are mounted pivotally about pivot pins 9 and which at the free end carry gripper jaws 10 coming into engagement, with the workpiece 2. The control of the manipulator is governed by the forging sequence.

Figure 2:
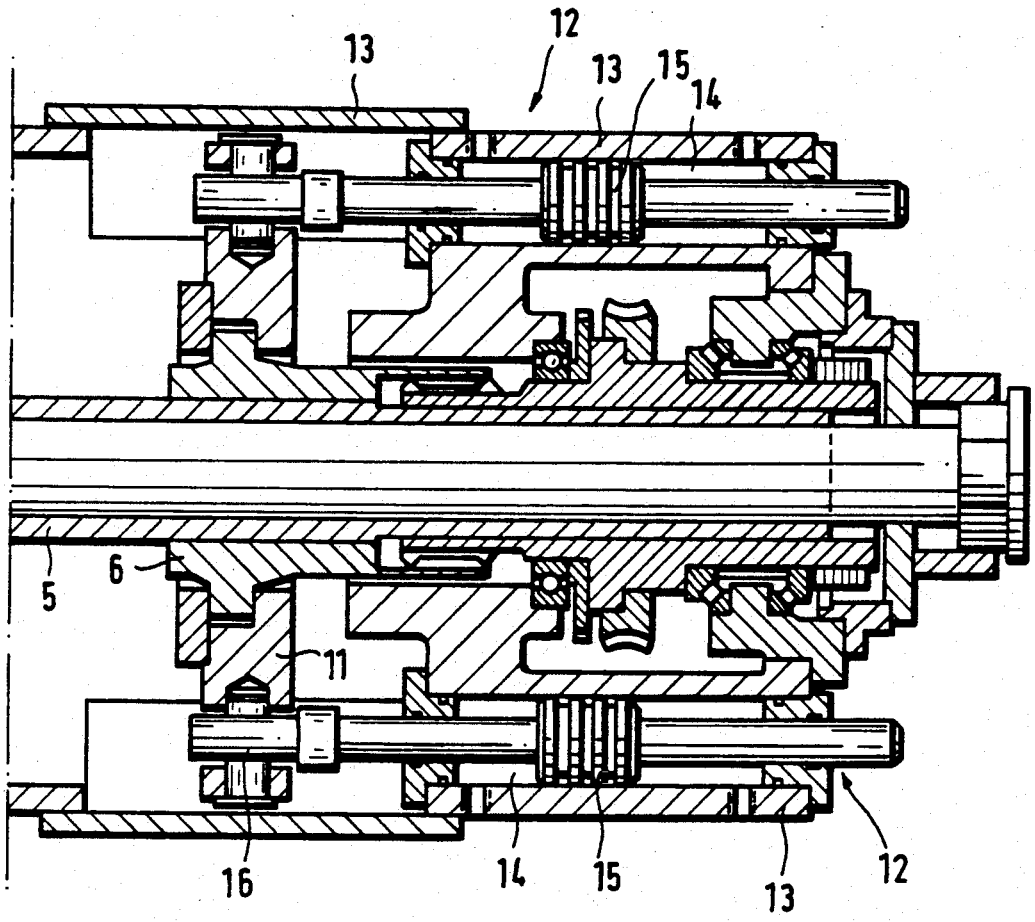
FIG. 2 shows an enlarged diagrammatic axial longitudinal section of the right-hand end of the manipulator of FIG. 1 rotated 90 degrees.
Figure 3:
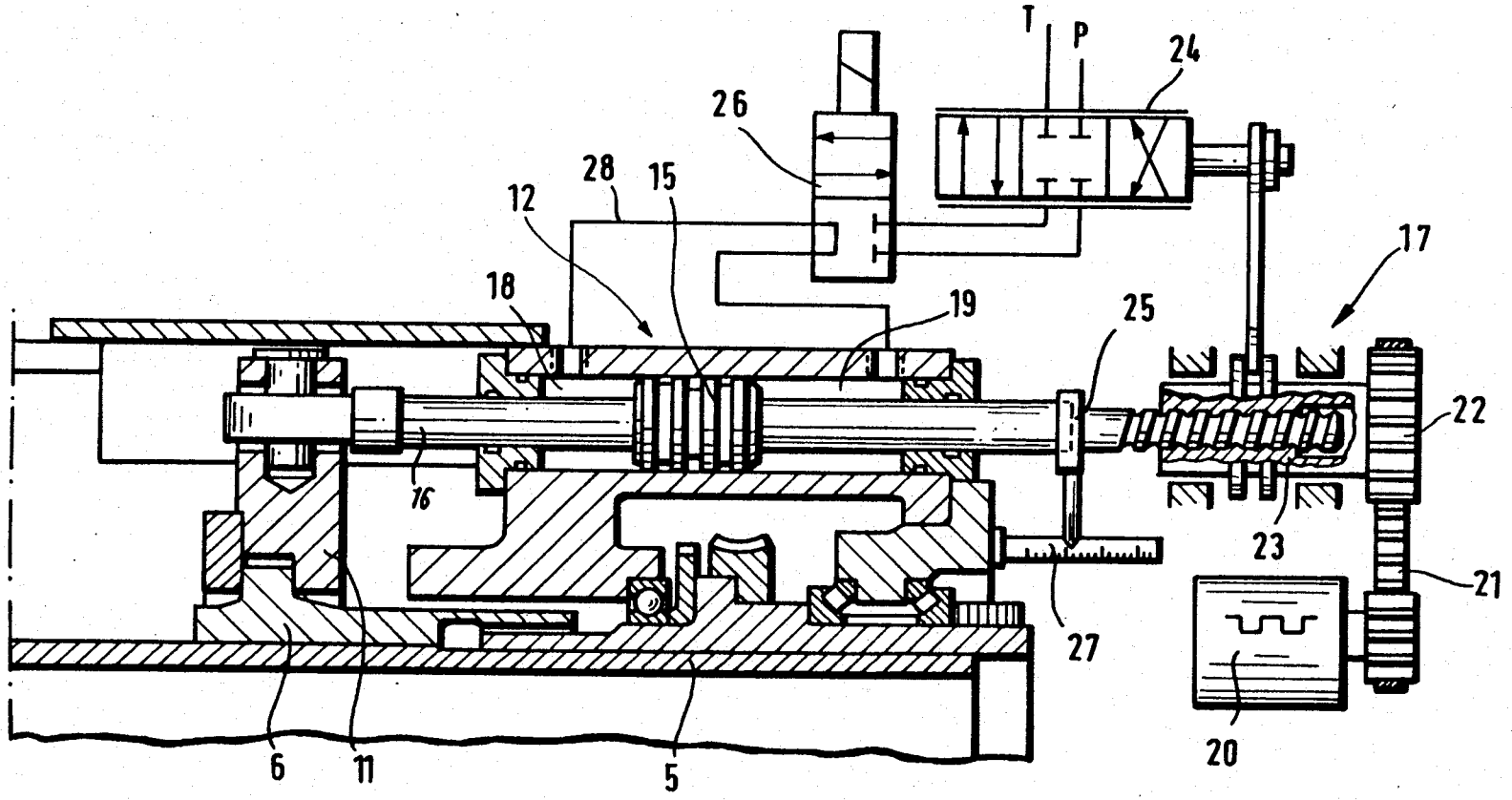
FIG. 3 illustrates in a basic diagram an embodiment of a servo-control device for controlling the axial movement of the gripper axle.

The axial support of the gripper axle 5 is obtained via an axial bearing 11 which surrounds the hub 6 and on which are arranged one or more hydraulically working piston/cylinder units 12 FIGS. 2 and 3. A piston 15 is hydraulically displaceable in a cylinder 14 mounted fixedly in a frame wall 13 or the like and is connected firmly to the axial bearing 11 by means of the piston rod 16.

The hydraulically working piston/cylinder unit 12 is advantageously designed as a servo-control device 17, so that a predeterminable movement characteristic for the axial movement of the gripper axle 5 can be generated by means of the control device 17. The servo-control device 17 with feedback by comparison of actual values and desired values makes it possible to influence the axial displacement of the gripper axle 5 in such a way that the gripper axle 5 comes to a standstill before the pressure-contact phase is reached by the rams.

In this case, the gripper axle 5 is moved at an appropriately constant speed in the opposite direction to the constant feed speed of the manipulator drive, and the relative speed of the gripper axle and workpiece in relation to the forging machine is thus brought to zero. During the pressure-contact phase, the active control of the piston/cylinder unit 12 is put out of action by means of a direct connection or line 28 of the stroke spaces 18 and 19 of the cylinder, and consequently, despite the constant feed drive 3 of the manipulator 1, the gripper axle 5 can, as a result of a superposed movement of the gripper axle 5, shift freely and without constraint relative to the manipulator housing 4 away from the non-predeterminable elongation of the workpiece caused by the forging process. After the end of the pressure-contact phase by the rams of the forging machine, the servo-control is reactivated, and the gripper axle 5 is returned and, before the next work cycle begins, accelerated once again to the oppositely directed manipulator speed. By means of the programmable control device 17 acting additionally on the axial displacement of the gripper axle 5 and functioning as a superposed drive, active intervention in the axial cycle of movement is obtained. It is possible by simple means for the forging machine now to be capable of working at different stroke frequencies, and the relative standstill times of the gripper axle of the manipulator can be adapted in a predeterminable way to the pressure-contact times of the rams. Moreover, as a result of the predeterminable direction of the axial shift of the gripper axle 5 relative to the manipulator housing 4, the constructional space for the displacement distance and therefore the mechanical outlay in terms of construction are appreciably reduced. The rotary drive for the gripper axle 5 is designated by 30, 31.

An exemplary embodiment of a servo-control device is explained by reference to FIG. 3. The piston/cylinder unit 12 is controlled by means of a servo-hydraulic valve 24. The desired-value input takes place rotationally, with the least possible power, for example by means of a stepping motor 20 which drives a belt pulley 22 by means of a transmission member, for example a toothed belt 21, and which acts on a spindle/nut system 23 of the servo-hydraulic valve 17, with the result that the rotational movement of the input shaft is converted into a linear movement in such a way that the movement of the valve 24 opens oppositely to the desired direction of movement of the piston 15. Because the threaded spindle 25 is fastened to the piston 15 fixedly in terms of rotation, the valve 24 is connected linearly directly to the piston 15, so that the actual position of the piston 15 acts on the valve 24 by means of the closed mechanical control circuit including the line 28, and the valve 24 is thus closed again when the predetermined desired value is reached. For the necessary interruption of the active control during the pressure-contact phase, the stroke spaces 18 and 19 of the piston/cylinder unit 12 are connected directly to one another as a result of a switching of the valve 26. To monitor the piston position and therefore the position of the gripper axle, the actual position of the piston 15 is detected via a separate path-measuring system 27 and is compared in the electrical control with the predetermined desired value.

We claim:

1. A manipulator for forging machines comprising drive means for acting intermittently upon an axially displaceable gripper axle of the manipulator, said gripper axle carrying gripper jaws for gripping a workpiece, said drive means comprising at least one hydraulically actuated piston/cylinder unit supporting and axially displacing the axially displaceable gripper axle relative to a housing of the manipulator, said cylinder of said piston/cylinder unit including front and rear stroke spaces defined on opposite sides of said piston of said piston/cylinder unit, hydraulic lines connected to said stroke spaces and to valve means which is selectively operable to place said stroke spaces into or out of fluid communication with each other through said hydraulic lines, and a servo-control means connected to said valve means for controlling the operation of said piston/cylinder unit via said valve means.

2. The manipulator as defined in claim 1 wherein said valve means include further valve means connected hydraulically to said first-mentioned valve means on the one hand and to a spindle/nut system of the servo-control device on the other hand.

3. The manipulator as defined in claim 1 wherein the servo-control means includes a threaded spindle which is fixedly connected in terms of rotation to the piston of the piston/cylinder unit.

4. The manipulator as defined in claim 2 wherein the servo-control means includes a threaded spindle which is fixedly connected in terms of rotation to the piston of the piston/cylinder unit.

* * * * *